United States Patent [19]

Burstall

[11] 3,996,737

[45] Dec. 14, 1976

[54] METHOD OF MANUFACTURING ELEVATOR LINKS AND A CAST ELEVATOR LINK BLANK FOR USE IN THE METHOD

[75] Inventor: William Mercer Burstall, Huffman, Tex.

[73] Assignee: BJ-Hughes Inc., Long Beach, Calif.

[22] Filed: Dec. 10, 1975

[21] Appl. No.: 639,525

[52] U.S. Cl. ..... 59/35 R; 59/90; 59/30

[51] Int. Cl.[2] ..... B21L 17/00; B22D 25/02

[58] Field of Search ..... 59/35, 84, 90, 30

[56] References Cited

UNITED STATES PATENTS

| | | | |
|---|---|---|---|
| 1,756,376 | 4/1930 | Moore | 59/35 |
| 1,779,895 | 10/1930 | White | 59/35 |
| 1,810,978 | 6/1931 | Moore | 59/35 |
| 2,822,663 | 2/1958 | Lutts | 59/35 |
| 3,461,666 | 8/1969 | Burstall | 59/35 |

*Primary Examiner*—Milton S. Mehr
*Attorney, Agent, or Firm*—John O. Evans, Jr.

[57] ABSTRACT

A method of making a one-piece elevator link having a shank with an eye at each end involving the steps of casting from alloy steel a link blank having an oversize shank portion, forging or swaging the shank portion to reduce its diameter and correspondingly elongate it, and heat treating and drawing the forged or swaged blank to enhance its physical and mechanical properties. The eyes are cast in their final form. The oversize shank portion may be machined to reduce its diameter before it is forged or otherwise hot worked, whereby castings of but one size may be used in the production of elevator links of varying lengths.

A cast elevator link blank to be hot worked into an elevator link of final form.

14 Claims, 4 Drawing Figures

METHOD OF MANUFACTURING ELEVATOR LINKS AND A CAST ELEVATOR LINK BLANK FOR USE IN THE METHOD

BACKGROUND OF THE INVENTION

1. Field of the Invention

This invention relates to a method of making a one-piece elevator link having a shank, an eye at one end of the shank, and another eye at the other end of the shank. Such elevator links are employed in matched pairs to suspend a pipe elevator from the block hook of an oil well drilling rig. The invention also relates to a cast elevator link blank.

2. Description of the Prior Art

Heretofore, weldless elevator links have been made in accordance with the manufacturing method described in U.S. Pat. No. 1,756,376, issued Apr. 29, 1930, to G. W. Moore, for "Method of Making Weldless Elevator Links." This known method involves rolling or forging a bar of uniform cross-sectional diameter into a section of reduced central diameter, both ends remaining the same dimension in cross section as the original bar, then flattening both ends, then cutting apertures in both ends to form eyes. In practice, after the apertures have been cut, the eyes and limited adjacent shank sections are forged in an open forging die to render them into final form. Finally, the flashing and irregularities are removed and the links are heat treated, quenched, and matched in sets so that the two links of each set are substantially equal in length.

In applicant's prior U.S. Pat. No. 3,461,666 issued Aug. 19, 1969, for "Elevator Link and Process of Making the Same", one of the elevator links shown in the drawings is fabricated by bending a metal bar having a grain structure substantially parallel to the axis of the bar into an elongated ring having generally parallel side sections spaced from each other at opposite ends to provide openings, and adjacent to each other intermediate the openings to provide a shank portion, in which the ends of the bar are substantially butted together in the shank portion; applying weld metal to the ends of the bar to join the ends together; and applying additional weld metal, adjacent to and including the weld metal applied to the ends of the bar, for joining the side sections together in the shank portion. After the welding has been completed, the shank portion of the link may be forged to reduce its cross-sectional area and elongate it, whereby to orient the grain structure of the weld metal in the direction of elongation. The other elevator link illustrated in the drawings is similar, but is made from two pieces of metal bars.

SUMMARY OF THE INVENTION

An object of the invention is to provide an improved process for making elevator links, which has fewer steps and is more economical than the heretofore practiced methods.

Another object is to provide a process for making elevator links wherein links having different lengths may be made from identical cast blanks.

These, and other objects that may appear hereinafter are achieved in a method of making a one-piece elevator link having a shank, a first eye at one end of the shank, and a second eye at the other end of the shank which comprises the steps of casting in a single piece from alloy steel an elevator link blank having a shank portion with a first eye at one end and a second eye at the other end, said eyes respectively having substantially the size and shape of the eyes desired in the finished elevator link; said shank portion having a diameter substantially greater than the diameter desired in the finished link and a length substantially less than the length desired in the shank of the finished link; and hot working said shank portion to reduce its diameter and correspondingly elongate it until the distance between the inner distal points of said eyes is substantially that desired in the finished elevator link.

In another aspect, the invention relates to a method of making a one-piece elevator link as set forth in the immediately preceding paragraph, further including the step of removing metal from the shank portion, as by machining, prior to the hot working step to initially reduce the diameter of the shank portion, and wherein the hot working step further reduces the diameter and correspondingly elongates the shank portion.

In yet another aspect, the invention relates to an elevator link blank comprising: a one-piece alloy steel casting having a shank portion with a first eye at one end and a second eye at the other end, said eyes respectively having substantially the size and shape of the eyes desired in a finished elevator link to be made from the blank; said shank portion having a diameter substantially greater than the diameter desired in the shank of the finished link and a length substantially less than the length desired in the shank of the finished link, said blank being adapted to have its shank portion hot worked to reduce its diameter and correspondingly elongate it until the distance between the inside distal portions of said eyes is substantially that specified for the finished elevator link.

DESCRIPTION OF THE PREFERRED EMBODIMENTS

Figure 1:
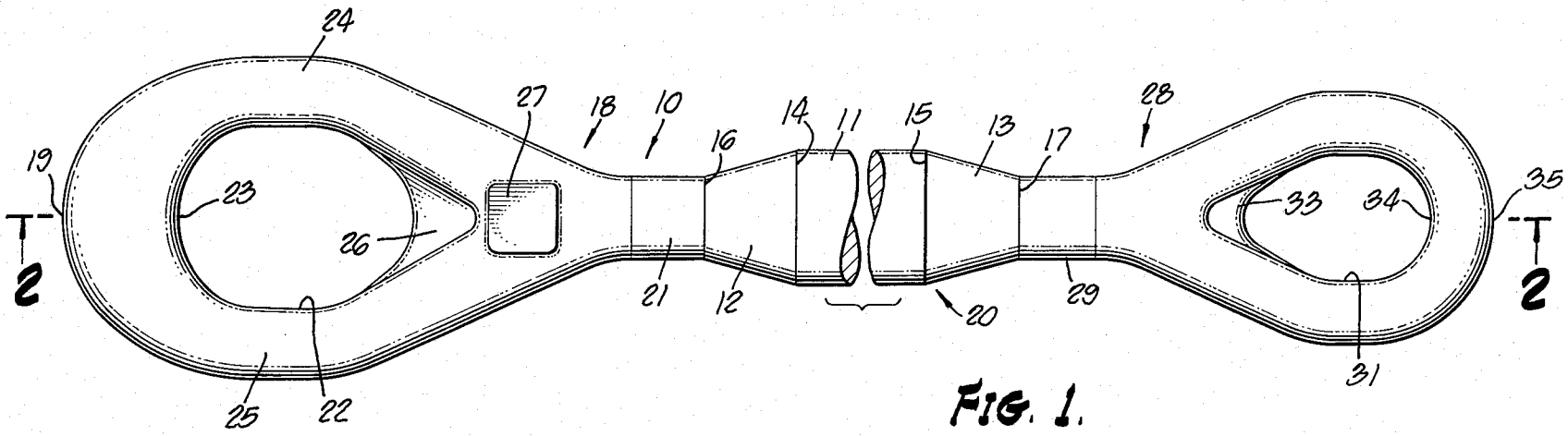
FIG. 1 is a plan view of a cast blank exemplary of the invention and from which an elevator link is made.
Figure 2:
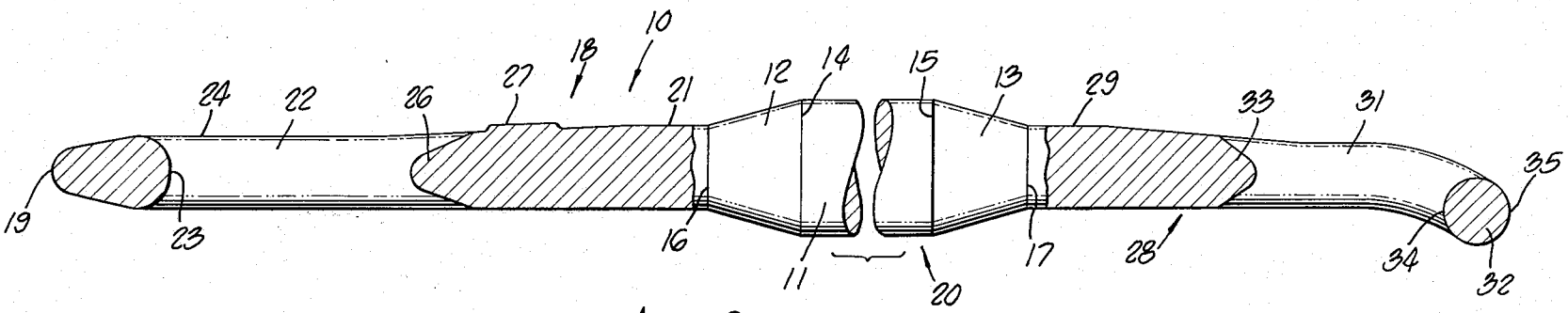
FIG. 2 is a sectional view taken along the line 2—2 of FIG. 1 looking in the direction of the arrows.

Referring to FIGS. 1 and 2 of the drawings, the elevator link blank 10 shown therein has a central cylindrical portion 11 merging into two truncated conical portions 12 and 13, one at each end and each having a major base 14, 15, respectively, with a diameter equal to the diameter of the central portion, and tapering, respectively, outwardly from opposite ends of the central portion. The conical portions are of the same height and have equal minor bases 16 and 17. The minor bases determine the shank portion 20 of the blank which is included therebetween.

The figures of the drawing show the blank and the link as being in horizontal positions. However, it will be understood that in use, the pair of links that support a pipe elevator from a block hook will be disposed vertically with their left-hand ends, as seen in the figures, being at the top and their right-hand ends at the bottom.

The upper eye 18 extends from the minor base 16 to the free end 19. The eye has a short cylindrical neck 21 extending from the minor base 16. In the exemplary blank shown, the diameter of the neck is the same as the diameter of the shank of the finished link. The neck merges into the generally oval part of the eye, which has an opening or aperture 22 to receive a conventional support ear on a block hook. The eye has an inner distal point 23 that rests on the support ear. The thickness of that part of the eye between the free end 19 and the point 23 is greater than the thickness of the sides 24 and 25 to allow for wear. An integral gusset 26 is provided at the inner end of the aperture 22 to strengthen the upper eye. A square boss 27, on which indicia (not shown) may be stamped or engraved, is formed on the eye. Typically, such indicia will include the serial number, the capacity, and the length of a matched pair of finished links.

The cast blank has a lower eye 28 at the end opposite the upper eye. The lower eye has a neck 29 that is cylindrical. It extends longitudinally outwardly from the minor base 17 and has the same diameter as the minor base, which is the shank diameter desired in the finished link. The neck 29 continues into a generally oval portion of the eye having an aperture 31 adapted to engage a conventional support ear on a pipe elevator. The cross section of the oval portion of the lower eye, as seen at 32 in FIG. 2, is circular throughout substantially its circumference. A reinforcing gusset 33 is provided at the inner end of the aperture 31. As best seen in FIG. 2, the outer or bottom end of the eye 28 is transversely curved to conform generally to the position of the support ear on the pipe elevator that is to be suspended by a pair of the finished links. An inner distal point 34 is defined on the eye 28, with the distance between the point 34 and the corresponding inner distal point 23 of the upper eye being the nominal length of the cast blank. The free end of the lower eye is designated by the reference numeral 35.

The steel blank shown in FIGS. 1 and 2 is cast in a mold from a pattern having the required shape and size. The pattern is the essential intermediary between the production drawing and a useful steel casting, since it gives its shape to the refractory mold cavity where the molten steel solidifies to the desired contour and dimensions. The mold is made by placing the pattern in a flask and then compressing or molding sand around it. The pattern may be split into two or more parts for the purpose of facilitating the molding operations. The pattern to be molded is so placed in the flask that after the sand has been rammed around it, the pattern can be removed from the sand without disturbing the impression left in the mold. Large gates are provided in the mold at selected places for the entry of molten metal into the cavity and for feeding the casting during solidification of the metal.

The preferred steel for making the cast blank is an alloy steel, such as AISI 4140. Some alloy steels and their properties are described in *Modern Steels and Their Properties*, Sixth Edition, Handbook 268-H, Bethlehem Steel Corporation, Bethlehem, Pa., U.S.A., 1967. Steels other than AISI 4140 can be used, depending upon the properties desired, as will be appreciated by an ordinarily skilled metallurgist. Such other steels include AISI 8640, AISI 4340, and AISI 9240.

The upper and lower eyes of the blank are cast to size, that is, to the contour, size and shape of the eyes required in the finished link. However, the shank portion is oversize and must be reduced in diameter. One method, in accordance with the invention, for accomplishing this is to hot work the shank portion down to the finished size, as by swaging the heated blank under hammer blows in a swaging die. As the diameter of the shank portion is reduced, its length is correspondingly increased.

Figure 3:
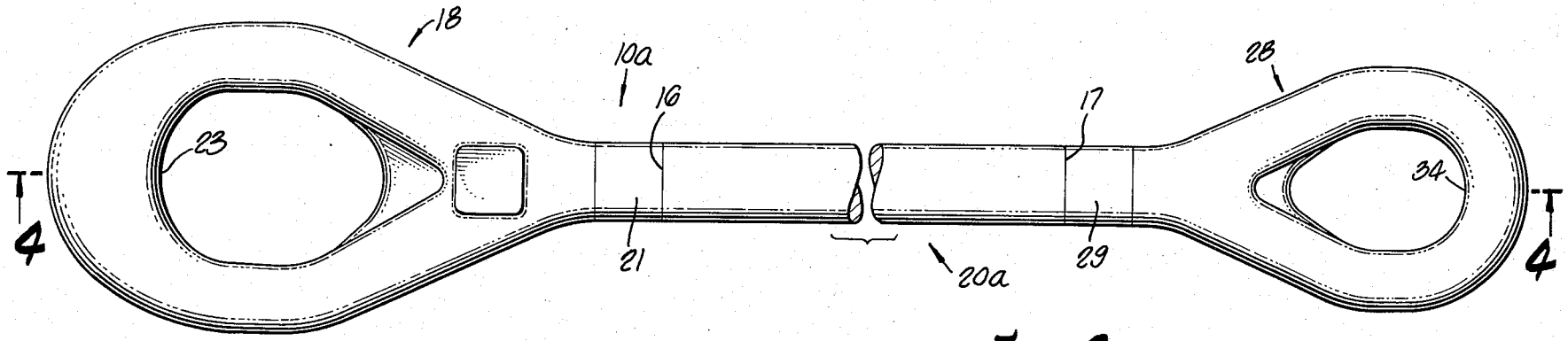
FIG. 3 is a view similar to FIG. 1 of an elevator link made from the blank shown in FIGS. 1 and 2.
Figure 4:
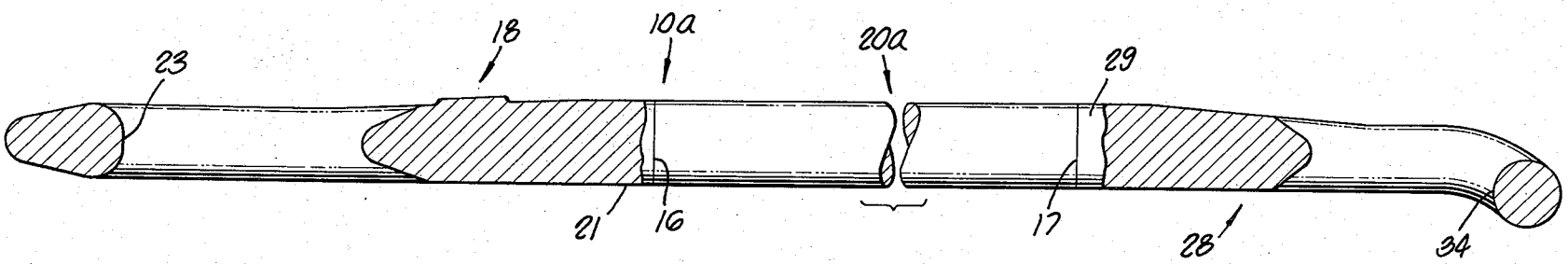
FIG. 4 is a sectional view taken along the line 4—4 of FIG. 3 looking in the direction of the arrows.

FIGS. 3 and 4 show the link 10*a* in finished size and shape subsequent to the swaging operation performed on the blank of FIGS. 1 and 2. As described hereinbefore, the upper and lower eyes 18 and 28 of the link 10*a* have the same dimensions as the corresponding eyes of the blank 10. However, the shank portion 20 of the blank is reduced in the link 10*a* to a cylindrical shank 20*a* of uniform diameter equal to the diameter of the necks 21 and 29.

A first example of the changes that result from the swaging operation are as follows. A cast blank, as shown in FIGS. 1 and 2, has the following dimensions:

| | |
|---|---|
| Overall length (between free ends 19 and 35) | = 66" |
| Length of conical section 12 | = 4" |
| Length of cylindrical section 11 | = 10" |
| Length of conical section 13 | = 4" |
| Length of shank portion 20 | = 18" |
| Diameter of minor bases 16 and 17 | = 3½" |
| Diameter of major bases 14 and 15 | = 9¼" |

The link as shown in FIGS. 3 and 4 and produced by the swaging of the shank portion of the foregoing blank has the following dimensions:

| | |
|---|---|
| Overall length | = 139¾" |
| Length of shank between minor bases 16 and 17 | = 91¾" |
| Diameter of shank | = 3½" |

As a result of the swaging, in the foregoing example, an overall elongation of 112% occurs, and an elongation of 410% occurs in the shank.

In the foregoing example, the dimensions of the blank are assumed, but typical, and the dimensions of the link produced by swaging the blank are calculated on the assumption that the volume of the shank after swaging is the same as its volume before swaging.

In practice, owing to variations in the dimensions of the castings and variations in the swaging operations, reasonable dimensional tolerances are accepted. As a practical matter, it is possible to consistently produce individual links that vary in length, as measured between the points 23 and 34, by not more than 1 inch over and not more than ½ inch under the specified lengths. A pair of run-of-the-mill links that vary by less than ⅛ inch in length are considered to be a matched pair, and are marked with the same serial number for identification and use as such.

The cast blank may be designed for the production of the longest link to be made, and for the production of shorter links, the shank of the casting is turned down or otherwise machined down to a size predetermined to provide the specified shorter length upon subsequent swaging of the shank to its specified size.

As an example of this method, the shank of a cast blank having the dimensions given in the foregoing first example is turned down on a lathe to a diameter 8¼ inches. The machined shank is then forged down to a diameter of 3½ inches. The resulting link has the following dimensions:

| | |
|---|---|
| Overall length | = 127¾" |
| Length of shank between minor bases 16 and 17 | = 79¾" |
| Diameter of shank | = 3½" |

In this example, the overall elongation is 94 %, and the elongation of the shank is 343 %. The dimensional changes in this example are calculated.

When the shank-machining step is performed to make shorter links, the links so produced are generally more uniform in length than those made directly from castings, this for the reason that the machined shanks have more uniform diameters than the cast shanks. The shorter links are matched in pairs, as previously described for the links made directly from castings.

Following the shank swaging or forging operation, irregularites are removed from the links, and they are then heat treated by heating them to the proper temperature and quenching them in oil. Thereafter, the links are drawn by reheating them to a specified temperature and cooling them in the atmosphere to give them the desired physical and mechanical properties and, at the same time, to refine the structure of the steel. Such heat treatment and drawing operations are well-known in the art, and are described in the foregoing publication of the Bethlehem Steel Corporation. In that publication, heat treatments of alloy steels are described on pages 38 to 41, and the properties and mass effect data for AISI 4140 steel are given on pages 122 and 123.

After being drawn, the scale is removed, the links are inspected, using non-destructive testing methods such as magnetic particle testing and radiographic inspection, and the links are painted, if desired.

The present method produces the lower and upper eyes by casting and the shank by casting and forging. The process of the foregoing patent to Moore requires forging of the entire link, as well as cutting the apertures for the upper and lower eyes. Thus, the present method involves less labor in the handling and manipulating of the links during forging, and eliminates the necessity of cutting apertures for the eyes and of forging the eyes themselves.

The process of the invention is adapted to the manufacture of elevator links having a wide range of lengths, yet requiring a pattern of only one size. This pattern is relatively short, which allows flasks of one short and convenient size to be used. The relatively compact configuration of the pattern and the mold cavity facilitates the molding and casting procedures, and enables the production of castings of excellent quality.

Although the shank portion of the casting and the shank of the link are shown and described herein as having circular cross sections, it will be understood that they may have other cross sections, such as oval, hexagonal, and the like. Therefore, the term "diameter", as used herein with reference to the shanks, should be construed broadly as a parameter of the cross section.

The foregoing description is to be understood as merely exemplary of the invention and not limitative thereof. Various changes and modifications of the processes specifically described herein may be made by those skilled in the art without departing from the invention as defined in the claims, which are to be construed as broadly as may be permitted by the prior art.

I claim:

1. A method of making a one-piece elevator link having a shank, a first eye at one end of the shank, and a second eye at the other end of the shank which comprises the steps of:

casting in a single piece from alloy steel an elevator link blank having a shank portion with a first eye at one end and a second eye at the other end, said eyes respectively having substantially the size and shape of the eyes desired in the finished elevator link; said shank portion having a diameter substantially greater than the diameter desired in the finished link and a length substantially less than the length desired in the shank of the finished link; and hot working said shank portion to reduce its diameter and correspondingly elongate it until the distance between the inner distal points of said eyes is substantially that desired in the finished elevator link.

2. A method of making a one-piece elevator link as defined in claim 1, wherein said hot working step is performed substantially only on said shank portion.

3. A method of making a one-piece elevator link as defined in claim 1, wherein said hot working step comprises the step of swaging.

4. A method of making a one-piece elevator link as defined in claim 1, wherein said hot working step comprises the step of forging.

5. A method of making a one-piece elevator link as defined in claim 1, including the step of removing metal from said shank portion prior to said hot working step to initially reduce the diameter of said shank portion, and wherein said hot working step further reduces the diameter of and correspondingly elongates said shank portion.

6. A method of making a one-piece elevator link as defined in claim 5, wherein said step of removing metal comprises the step of machining said shank portion.

7. A method of making a one-piece elevator link as defined in claim 5, wherein said step of removing metal comprises the step of turning said shank portion.

8. A method of making a one-piece elevator link as defined in claim 1, wherein said shank portion has truncated conical portions at each end that merge into said eye sections.

9. A method of making a one-piece elevator link as defined in claim 1, wherein said alloy steel has a composition defined by the specification AISI 4140.

10. A method of making a one-piece elevator link as defined in claim 1, including the additional steps of heat treating and drawing the hot worked link.

11. A method of making a one-piece elevator link having a right-cylindircal shank, a first eye at one end of the shank, and a second eye at the other end of the shank which comprises the steps of:

casting in a single piece from alloy steel an elevator link blank having a shank portion including a right-cylindrical central section and a truncated conical section at each end, one of said conical sections tapering towards and merging into a first eye and the other tapering towards and merging into a second eye, said eyes respectively having substantially the size and shape of the eyes desired in the finished elevator link, said central section having a diameter substantially greater than the diameter desired in the shank of the finished link and a length substantially less than the length desired in the shank of the finished link; and swaging substantially only said shank portion to reduce its diameter and correspondingly elongate it into a right-cylindrical form until the distance between the inner distal points of said eyes is substantially that desired in the finished elevator link.

12. A method of making a one-piece elevator link as defined in claim 11, including the step of turning said shank portion to remove metal therefrom prior to said swaging step to initially reduce the diameter of said shank portion, and wherein said swaging step further reduces the diameter of and correspondingly elongates said shank portion.

13. A method of making a one-piece elevator link as defined in claim 11, including the additional steps of heat treating and drawing the swaged link.

14. An elevator link blank comprising: a one-piece alloy steel casting having a shank portion with a first eye at one end and a second eye at the other end, said eyes respectively having substantially the size and shape of the eyes desired in a finished elevator link to be made from the blank; said shank portion having a diameter substantially greater than the diameter desired in the shank of the finished link and a length substantially less than the length desired in the shank of the finished link; said blank being adapted to have its shank portion hot worked to reduce its diameter and correspondingly elongate it until the distance between the inside distal portions of said eyes is substantially that specified for finished elevator link.

* * * * *